US006964148B2

(12) United States Patent
Spatafora

(10) Patent No.: US 6,964,148 B2
(45) Date of Patent: Nov. 15, 2005

(54) METHOD OF WRAPPING ORDERLY GROUPS OF CIGARETTES

(75) Inventor: Mario Spatafora, Bologna (IT)

(73) Assignee: G.D Societa' Per Azioni, Bologna (IT)

( * ) Notice: Subject to any disclaimer, the term of this patent is extended or adjusted under 35 U.S.C. 154(b) by 0 days.

(21) Appl. No.: 10/827,038

(22) Filed: Apr. 19, 2004

(65) Prior Publication Data

US 2004/0255559 A1 Dec. 23, 2004

(30) Foreign Application Priority Data

Apr. 21, 2004 (IT) ..... BO2003A000249

(51) Int. Cl.[7] ..... B65B 11/00

(52) U.S. Cl. ..... 53/466

(58) Field of Search ..... 53/225, 234, 575, 53/579, 461, 466, 456, 444, 447

(56) References Cited

U.S. PATENT DOCUMENTS 6,269,931 B1 * 8/2001 Tale' et al. ..... 198/418.3

* cited by examiner

*Primary Examiner*—John Paradiso
(74) *Attorney, Agent, or Firm*—Marshall, Gerstein & Borun LLP

(57) ABSTRACT

A method of wrapping orderly groups of cigarettes arranged, in each group, in a number of superimposed layers, of which an outer layer is narrower than the adjacent layer and defines, in the relative group, at least one longitudinal lateral gap, the method providing for continuously feeding each group into a respective folding pocket, together with a sheet of wrapping material which is folded into a U inside the folding pocket and has a lateral portion projecting from the folding pocket; clamping the group on an end wall of the folding pocket, with the outer layer of the group facing outwards, by means of two end clamping members, each having an appendix arranged at a respective end of the longitudinal lateral gap; and folding the lateral portion of the sheet about the group and about the appendixes of the end clamping members to form a rectangular parallelepiped-shaped tubular wrapping.

7 Claims, 3 Drawing Sheets

METHOD OF WRAPPING ORDERLY GROUPS OF CIGARETTES

CROSS-REFERENCE TO RELATED APPLICATION

This application claims the benefit of Italian Patent Application Ser. No. BO2003A 000249, filed Apr. 29, 2003.

The present invention relates to a method of wrapping orderly groups of cigarettes, in which the cigarettes are arranged in a number of superimposed layers to form a substantially rectangular parallelepiped-shaped group.

BACKGROUND OF THE INVENTION

Each group of the type defined above is normally wrapped by feeding it into a respective U-shaped folding pocket travelling along a given wrapping path and bounded by two lateral walls and an end wall. The group is fed into the relative folding pocket together with a sheet of wrapping material, which, on inserting the group inside the folding pocket, is folded into a U so that two opposite parallel lateral portions contact the lateral walls of the folding pocket, and respective end portions project from the folding pocket. The group is then clamped contacting the end wall of the folding pocket by two end clamping members before said end portions are folded about the group and the end clamping members to form a tubular wrapping.

The known wrapping method described above produces substantially perfect tubular wrappings, i.e. rectangular parallelepiped-shaped to assist follow-up wrapping operations, when the cigarettes, e.g. 20 in number, are arranged in a 7-6-7 configuration, i.e. in which the two outer layers are the same width and either wider than or the same width as the middle layer.

The same does not apply, however, when the layer facing outwards of the relative folding pocket is narrower than the adjacent layer, i.e. when the 20 cigarettes are arranged, for example, in a 6-7-7 configuration, or when, for tax or cost reasons, for example, the group contains fewer than 20 cigarettes, and the layer facing outwards of the relative folding pocket comprises fewer cigarettes than the adjacent layer. In which case, the narrower outer layer defines, with the adjacent layer, at least one longitudinal lateral gap (normally two opposite longitudinal gaps) where the end portion of the relative lateral portion of the sheet of wrapping material is not supported when folded onto the outer layer of the group, so that the resulting tubular wrapping is not of the desired rectangular parallelepiped shape.

SUMMARY OF THE INVENTION

It is an object of the present invention to improve the above known wrapping method to form a round-edged rectangular parallelepiped-shaped tubular wrapping about the group, even when the outer layer is narrower than the adjacent inner layer.

According to the present invention, there is provided a method of wrapping orderly groups of cigarettes, as claimed in claim 1 and, preferably, in any one of the following claims depending directly or indirectly on claim 1.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 2:
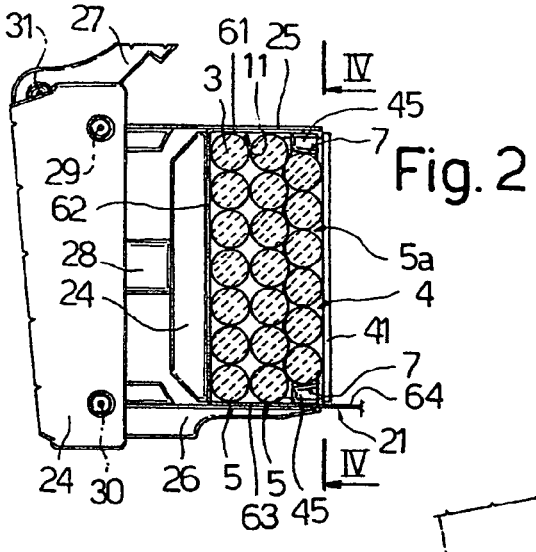
FIG. 2 shows a larger-scale detail of FIG. 1.
Figure 1:
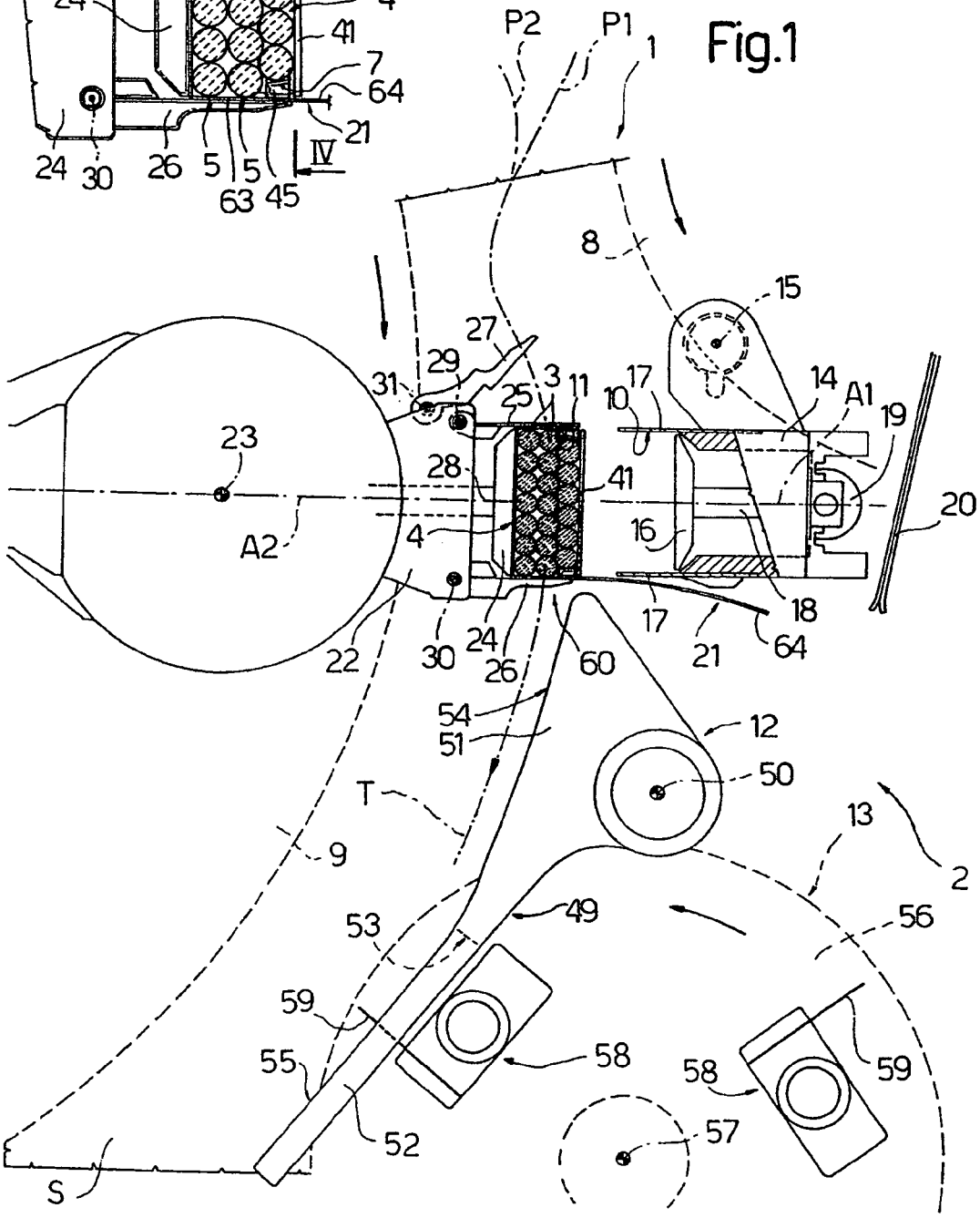
FIG. 1 shows a schematic side view, with parts in section and parts removed for clarity, of a wrapping unit implementing the method according to the present invention.

Number 1 in FIG. 1 indicates as a whole a wrapping unit of a packing machine 2 for packing cigarettes 3 arranged in groups 4 defined by a number of superimposed layers 5, of which an outer layer, indicated 5*a*, is narrower than the adjacent inner layer 5. Each group 4 is substantially in the form of a rectangular parallelepiped, a longitudinal axis 6 (FIG. 3) of which extends parallel to cigarettes 3 in group 4, and layer 5*a* defines, with the adjacent inner layer 5, at least one longitudinal lateral gap 7. In the example shown, each group 4 comprises twenty cigarettes 3 arranged in three layers 5 in a 7-7-6 configuration; and layer 5*a*, comprising six cigarettes 3 laterally offset with respect to cigarettes 3 in the adjacent inner layer 5, defines, with the adjacent inner layer 5 comprising seven cigarettes 3, two longitudinal lateral gaps 7 on opposite sides of layer 5*a*.

Unit 1 comprises two wheels 8 and 9 shown by dash lines in FIG. 1 and fitted to a fixed frame S to rotate about respective axes (not shown) parallel to each other and perpendicular to the FIG. 1 plane. Wheels 8 and 9 support, respectively, a succession of feed pockets 10 (only one shown) travelling along an endless path P1, and a succession of folding pockets 11 (only one shown) travelling along an endless path P2 having a portion T in common with path P1.

Unit 1 also comprises two folding devices 12 and 13 located along path P2 and cooperating successively with pockets 11.

Each feed pocket 10 comprises a frame 14 fitted to wheel 8 to oscillate in controlled manner, by means of a known cam device not shown, about a respective axis 15 perpendicular to the FIG. 1 plane; an end wall 16; and two lateral walls 17 supported by frame 14. End wall 16 is connected integrally to a rod 18, which is connected in sliding manner to frame 14 and activated by a cam device 19 to move end wall 16, between lateral walls 17 and along an axis A1 crosswise to relative axis 15, between a withdrawn rest position and an extracted work position.

Lateral walls 17 are defined by two facing, parallel, thin flat plates, are parallel to axis A1, and are fixed rigidly to frame 14.

Downstream from each feed pocket 10, wheel 8 supports a gripper 20, of known design and operation, which extends radially from wheel 8 to grip the end of a sheet 21 of wrapping material from a known feed device not shown, and to draw sheet 21 of wrapping material in front of relative feed pocket 10 along a portion of path P1 including common portion T.

Each folding pocket 11 comprises a frame 22 fitted to wheel 9 to oscillate in controlled manner about an axis 23 parallel to axes 15; an end wall 24; two lateral walls 25 and 26; and a jaw 27 located outwards of lateral wall 25.

Figure 3:
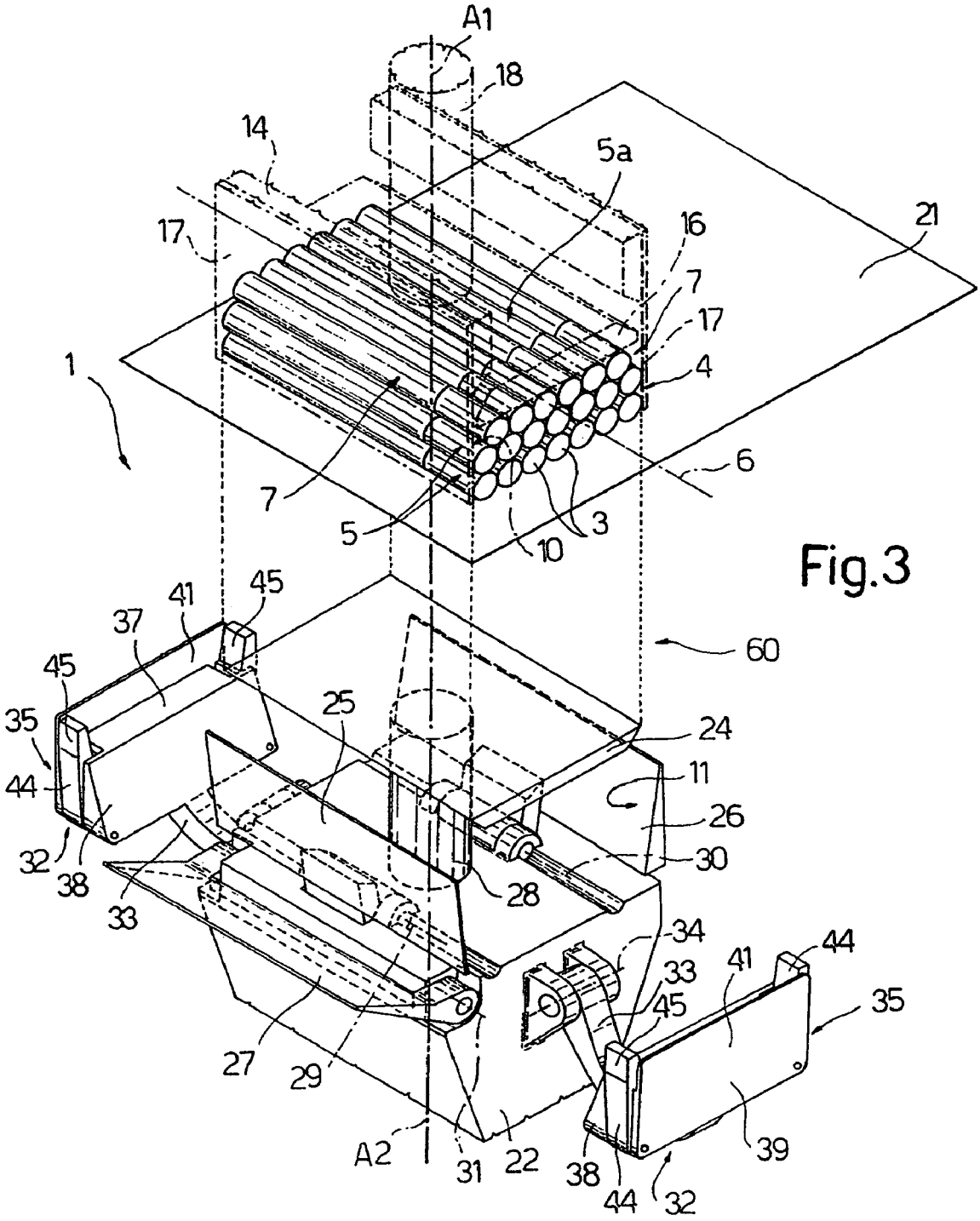
FIG. 3 shows a larger-scale view in perspective of a detail in FIG. 1.

With reference to FIGS. 1 and 3, each end wall 24 is connected integrally to a relative rod 28, which is connected in sliding manner to relative frame 22 and activated by a known cam device (not shown) to move end wall 24, between lateral walls 25 and 26 and along an axis A2 crosswise to relative axis 23, between a withdrawn rest position and an extracted work position.

Lateral walls 25 and 26 are mounted to oscillate, under the control of respective known cam devices (not shown), about respective axes 29 and 30 parallel to relative axis 23, are located on opposite sides of relative end wall 24, and are movable, about respective axes 29 and 30, between an open rest position, in which lateral walls 25 and 26 diverge outwards of relative folding pocket 11, and a closed work position, in which lateral walls 25 and 26 are parallel to each other and to axis A2, and perpendicular to end wall 24. Jaw 27 is fitted to frame 22 to oscillate, with respect to frame 22 and about an axis 31 parallel to axes 29 and 30, between an open rest position, in which jaw 27 diverges outwards with respect to lateral wall 25 in the open rest position, and a closed-work position, in which jaw 27 is parallel to and substantially contacts lateral wall 25 in the closed work position.

Figure 4:
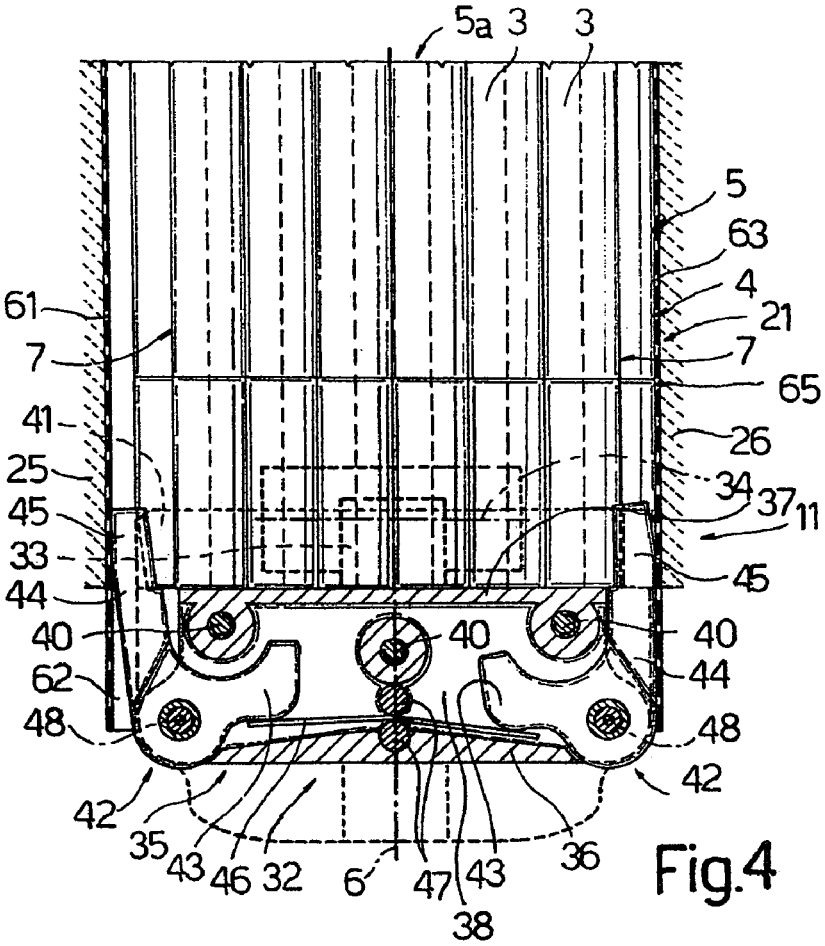
FIG. 4 shows a partial section along line IV—IV in FIG. 2 of the FIG. 2 detail in two different operating positions.
Figure 5:
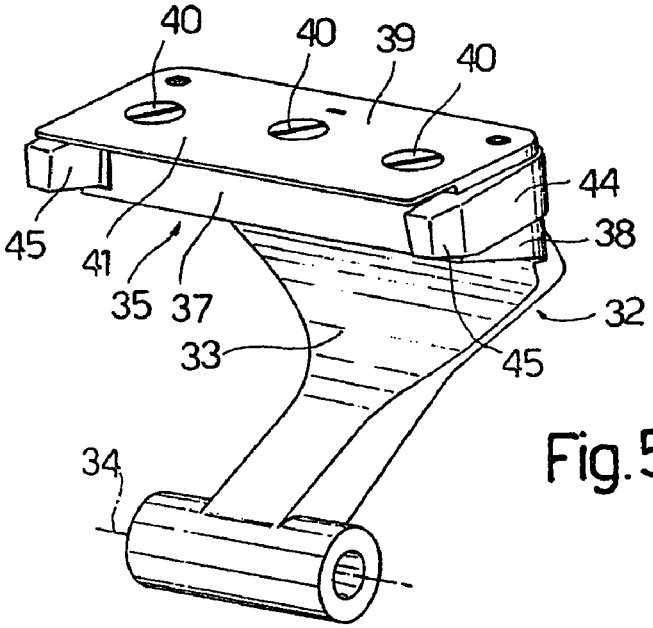
FIG. 5 shows a larger-scale view in perspective of a detail in FIG. 3.

Each folding pocket 11 also comprises two end clamping members 32—shown in detail in FIGS. 4 and 5—located at opposite longitudinal ends of folding pocket 11, and each comprising a U-shaped arm 33, a first end of which is hinged to frame 22 to oscillate, with respect to frame 22, about a respective axis 34 crosswise to axes 29–31, and a second end of which is fitted integrally with a tubular, substantially rectangular parallelepiped-shaped head 35 projecting from relative arm 33 towards the other clamping member 32. Each head 35 comprises two lateral walls 36 and 37 parallel to relative axis 34, and of which lateral wall 36 forms an extension of relative arm 33, while wall 37 faces relative lateral walls 25 and 26 and is shorter than wall 36; a bottom wall 38 connecting lateral walls 36 and 37; and a lid 39 which is connected to bottom wall 38 by screws 40, is as wide as wall 36, and projects from wall 37 to form a plate 41.

As it is oscillated about relative axis 34 by a known cam device not shown, each head 35 moves to and from a closed work position (FIG. 4) in which the outer surface of lateral wall 37 is perpendicular to end wall 24 and coplanar with a relative longitudinal end of end wall 24.

The opposite lateral ends of head 35 are open, and are each engaged by a respective rocker arm 42 comprising an arm 43 extending inside head 35, and a further arm 44 substantially perpendicular to relative arm 43 and to lateral walls 36 and 37. More specifically, arm 44 extends towards relative wall 37, and an end portion of it defines an appendix 45 projecting from lateral wall 37. Each head 35 also comprises a leaf spring 46 which cooperates with arm 43 of each rocker arm 42, is located between bottom wall 38 and lid 39 and adjacent to lateral wall 36, and is hinged centrally between two pins 47 extending from bottom wall 38 and parallel to screws 40.

Each rocker arm 42 is fitted to bottom wall 38 to oscillate about a relative axis 48 parallel to screws 40 and adjacent to wall 36, and, when relative head 35 is in the closed work position, oscillates about relative axis 48, in opposition to leaf spring 46, from an extracted rest position (left-hand side of FIG. 4), in which relative arm 44 cooperates with the inner surface of relative lateral wall 25, 26 in the open rest position, to a withdrawn work position (right-hand side of FIG. 4), in which relative arm 44 cooperates with the inner surface of relative lateral wall 25, 26 in the closed work position.

With reference to FIG. 1, folding device 12 is fitted to frame S, and comprises a plate 49 mounted to oscillate in known controlled manner about an axis 50 perpendicular to the FIG. 1 plane. Plate 49 comprises a curved portion 51; and a flat portion 52 with slots 53 for insertion of part of device 13, as explained later on. Curved portion 51 and flat portion 52 have respective faces 54 and 55 connected to each other and facing wheel 9.

Folding device 13 comprises a wheel 56 shown by a dash line in FIG. 1 and rotating, with respect to frame S, about an axis 57 parallel to axis 50. Wheel 56 comprises three folding members 58 equally spaced about axis 57 and having blades 59 which, in use, engage slots 53 comb-fashion to project from face 55 towards wheel 9.

In actual use, wheels 8, 9 and 56 rotate continuously, wheel 9 clockwise and wheels 8 and 56 anticlockwise in FIG. 1. As wheels 8 and 9 rotate, pockets 10 and 11 are oscillated about respective axes 15 and 23 by known cam devices (not shown) commonly used on automatic machines and comprising pawls, levers, and cam profiles (not shown) for specifically orienting pockets 10 and 11, along respective paths P1 and P2, with respect to wheels 8 and 9. The movements of lateral walls 25 and 26, jaw 27, end walls 16 and 24, plate 49, and folding members 58 are controlled by similar cam devices operated by rotation of wheels 8 and 9. The timing of wheels 8 and 9, and oscillation of pockets 10 and 11 about respective axes 15 and 23, are such as to align axes A1 and A2 and insert feed pocket 10 inside folding pocket 11 along common portion T of paths P1 and P2. As wheel 8 rotates, and upstream from portion T, gripper 20 grips a sheet 21 of wrapping material, supplied in known manner not shown, and retains sheet 21 of wrapping material in a given position with respect to feed pocket 10.

The following is a description of the way in which a group 4, housed inside a feed pocket 10, is transferred to a corresponding folding pocket 11 as pockets 10 and 11 travel through a transfer station 60 located along a portion of common portion T, and where axis A1 of feed pocket 10 and axis A2 of the corresponding folding pocket 11 are aligned and kept aligned by pockets 10 and 11 oscillating in opposite directions about respective axes 15 and 23.

Feed pocket 10 reaches transfer station 60 in the FIG. 3 configuration, i.e. with end wall 16 in the withdrawn rest position, and with relative group 4 located between lateral walls 17 with layer 5*a* resting against end wall 16; and the corresponding folding pocket 11 also reaches transfer station in the FIG. 3 configuration, i.e. with end wall 24 moving into the extracted work position, with lateral walls 25 and 26 and jaw 27 in the open rest position, and with end clamping members 32 rotated outwards with respect to folding pocket 11, with arms 44 maintained in the extracted rest position by leaf springs 46.

As of the FIG. 3 configuration, feed pocket 10, as it travels through transfer station 60, is gradually inserted inside folding pocket 11, and end wall 24 is positioned contacting layer 5*a* of group 4 with the interposition of sheet 21 of wrapping material. As feed pocket 10 is eased inside folding pocket 11, end wall 24 moves into the withdrawn rest position, accompanied at all times by end wall 16, seeing as how group 4 is gripped at all times between end walls 16 and 24 as it is transferred between pockets 10 and 11. During transfer, sheet 21 is folded into a U to define a portion 61 interposed between part of lateral wall 25 and the corresponding lateral wall 17; a portion 62 interposed between group 4 and end wall 24; a portion 63 interposed between part of lateral wall 26 and the corresponding lateral wall 17; and a lateral end portion 64 substantially parallel to axes A1 and A2 and projecting from folding pocket 11 towards feed pocket 10.

At this point, the two end clamping members 32 are moved into the closed work position, in which lateral wall 37 of each head 35 rests against the respective axial end of layer 5*a*, and plate 41 of each head 35 engages from the outside a relative end portion of layer 5*a* to hold group 4, by the end, on end wall 24. Over a final portion of the movement of each clamping member 32 into the closed work position, end appendixes 45 of relative arms 44, kept in an outwardly diverging position by relative leaf spring 46, gradually engage the inner surfaces of relative lateral walls 17 of feed pocket 10, and are folded towards each other, in opposition to relative leaf spring 46, to engage respective ends of respective longitudinal lateral gaps 7.

At the same time, lateral walls 25 and 26 are moved into the closed work position, in which lateral wall 25 contacts the outer surface of relative lateral wall 17 of feed pocket 10, with the interposition of portion 61 of sheet 21, and lateral wall 26 contacts the outer surface of relative lateral wall 17 of feed pocket 10, with the interposition of portion 63 of sheet 21.

On nearing the output of transfer station 60, feed pocket 10 is disengaged from folding pocket 11 to release end appendixes 45, each of which moves slightly outwards to substantially contact relative lateral wall 25, 26, with the interposition of relative portion 61, 63 of sheet 21, which is kept perfectly taut.

Downstream from transfer station 60, folding pocket 11 successively engages folding devices 12 and 13; folding device 12 folds lateral portion 64 by 90° onto outer layer 5*a* and about appendixes 45, which compensate for longitudinal lateral gaps 7, and about plates 41; and a blade 59 of a folding member 58 of folding device 13 is inserted through slots 53 to fold by a further 90°, and onto the outer surface of lateral wall 25, an end portion of lateral portion 64 projecting from lateral wall 25. Before blade 59 of said folding member 58 is withdrawn from the gap between lateral wall 25 and jaw 27, jaw 27 is closed to clamp said end portion of lateral portion 64 in position, and so define about group 4 a tubular wrapping 65 which, by virtue of appendixes 45, is substantially rectangular parallelepiped-shaped despite longitudinal lateral gaps 7 in group 4.

Once tubular wrapping 65 is completed and closed by jaw 27, end clamping members 32 can be opened and extracted from tubular wrapping 65 to close the ends of tubular wrapping 65 in known manner not shown) and form a closed wrapping (not shown). As end clamping members 32 are extracted from tubular wrapping 65, leaf springs 46 push appendixes 45 into the extracted rest position to perfect the relative folds of tubular wrapping 65.

Both tubular wrapping 65 and the closed wrapping (not shown) have portion 61 of sheet 21 of wrapping material and said end portion of lateral portion 64 separated by lateral wall 25. This in no way impairs expulsion of the closed wrapping from folding pocket 11, which is done by simply opening jaw 27 and activating end wall 24 to slide portion 61 and said end portion of portion 64 with respect to lateral wall 25 and expel the wrapped group 4.

In connection with the above, it should be pointed out that, despite longitudinal lateral gaps 7 in group 4, the resulting tubular wrapping 65 is in the form of a substantially perfect rectangular parallelepiped, in that, in tubular wrapping 65, the longitudinal edges on opposite sides of portion 62 are formed about the free end edges of lateral walls 17, a further longitudinal edge is formed about two of appendixes 45, which cooperate with the other two appendixes 45 to keep the portion of sheet 21 of wrapping material on layer 5*a* perfectly taut, and the last longitudinal edge is formed about the free end edge of lateral wall 25.

What is claimed is:

1. A method of wrapping orderly groups (4) of cigarettes (3) arranged, in each group (4), in a number of superimposed layers (5, 5*a*), of which an outer layer (5*a*) is narrower than the adjacent layer (5) and defines, in the relative group (4), at least one longitudinal lateral gap (7), the method comprising the steps of feeding each group (4) into a respective folding pocket (11), together with a sheet (21) of wrapping material which is folded into a U inside said folding pocket (11) and has a lateral portion (64) projecting from the folding pocket (11); clamping the group (4) inside said folding pocket (11), with the outer layer (5*a*) of the group facing outwards, by moving into a closed work position two end clamping members (32), each having an appendix (45) which engages a respective end of said longitudinal lateral gap (7) when the relative end clamping member (32) is moved into said closed work position; folding the lateral portion (64) of said sheet (21) of wrapping material about the group (4) and about the appendixes (45) of the end clamping members (32) to form a rectangular parallelepiped-shaped tubular wrapping (65) about said group (4); and extracting the end clamping members (32) from said tubular wrapping (65).

2. A method as claimed in claim 1, wherein, inside said folding pocket (11), said sheet (21) of wrapping material is made taut by subjecting each said appendix (45) to thrust outwards of the folding pocket (11).

3. A method as claimed in claim 2, wherein said thrust is elastic thrust.

4. A method as claimed in claim 2, wherein said thrust is maintained while extracting the end clamping members (32) from said tubular wrapping (65).

5. A method as claimed in claim 1, wherein said folding pocket (11) comprises two first lateral walls (25, 26) movable to and from a closed work position, in which said two first lateral walls (25, 26) are perpendicular to an end wall (24) of the folding pocket (11); said sheet (21) of wrapping material being folded into a U inside said folding pocket (11) by feeding the sheet (21) of wrapping material and the relative said group (4) into said folding pocket (11) by means of a feed pocket (10) having two second lateral walls (17), by inserting said feed pocket (10) inside said folding pocket (11) so that the ends of said second lateral walls (17) substantially contact said end wall (24), and by moving said first lateral walls (25, 26) into said closed work position contacting said second lateral walls (17).

6. A method as claimed in claim 5, wherein said tubular wrapping (65) is formed by folding said lateral portion (64) of said sheet (21) of wrapping material first about said appendixes (45) onto said outer layer (5*a*), and then about an edge of one (25) of said first lateral walls (25, 26), and by clamping an end portion of said lateral portion (64) onto an outer surface of said first lateral wall (25).

7. A method as claimed in claim 6, wherein said end portion of said lateral portion (64) is clamped onto the outer surface of said first lateral wall (25) by a jaw (27) carried by said folding pocket (11) outwards of said first lateral wall (25).

* * * * *

UNITED STATES PATENT AND TRADEMARK OFFICE

CERTIFICATE OF CORRECTION

PATENT NO. : 6,964,148 B2
DATED : November 15, 2005
INVENTOR(S) : Mario Spatafora It is certified that error appears in the above-identified patent and that said Letters Patent is hereby corrected as shown below:

Title page,
Item [30], Foreign Application Priority Data, "April 21, 2004" should be -- April 29, 2003 --.

Signed and Sealed this

Fourth Day of April, 2006

JON W. DUDAS
*Director of the United States Patent and Trademark Office*